United States Patent [19]

Fuchs

[11] 4,022,164

[45] May 10, 1977

[54] ELECTRIC IDLE FOR INTERNAL COMBUSTION ENGINE

[75] Inventor: John R. Fuchs, Leawood, Kans.

[73] Assignee: General Motors Corporation, Detroit, Mich.

[22] Filed: Jan. 28, 1976

[21] Appl. No.: 652,905

[52] U.S. Cl. ..... 123/1 R; 123/198 F

[51] Int. Cl.[2] ..... F02B 75/12

[58] Field of Search ..... 123/1 R, 2, 179 A, 179 G, 123/198 F, 198 R; 290/18, 21; 60/698, 710, 720

[56] References Cited

UNITED STATES PATENTS

| | | | |
|---|---|---|---|
| 913,846 | 3/1909 | Pieper | 290/21 |
| 1,459,726 | 6/1923 | Goodheim | 290/18 |
| 2,748,760 | 6/1956 | Stoltman | 123/179 A |
| 2,757,651 | 8/1956 | Winkler | 123/198 F X |

*Primary Examiner*—C. J. Husar
*Assistant Examiner*—Ira S. Lazarus
*Attorney, Agent, or Firm*—Warren D. Hill

[57] ABSTRACT

An internal combustion engine is controlled by a throttle valve which can close completely to prevent fuel flow to the engine. There is no idle jet below the throttle valve. When the engine is at idle speed, the starter motor is energized to maintain engine rotation so that no fuel is consumed during engine idling.

1 Claim, 2 Drawing Figures

ELECTRIC IDLE FOR INTERNAL COMBUSTION ENGINE

Figure 1:
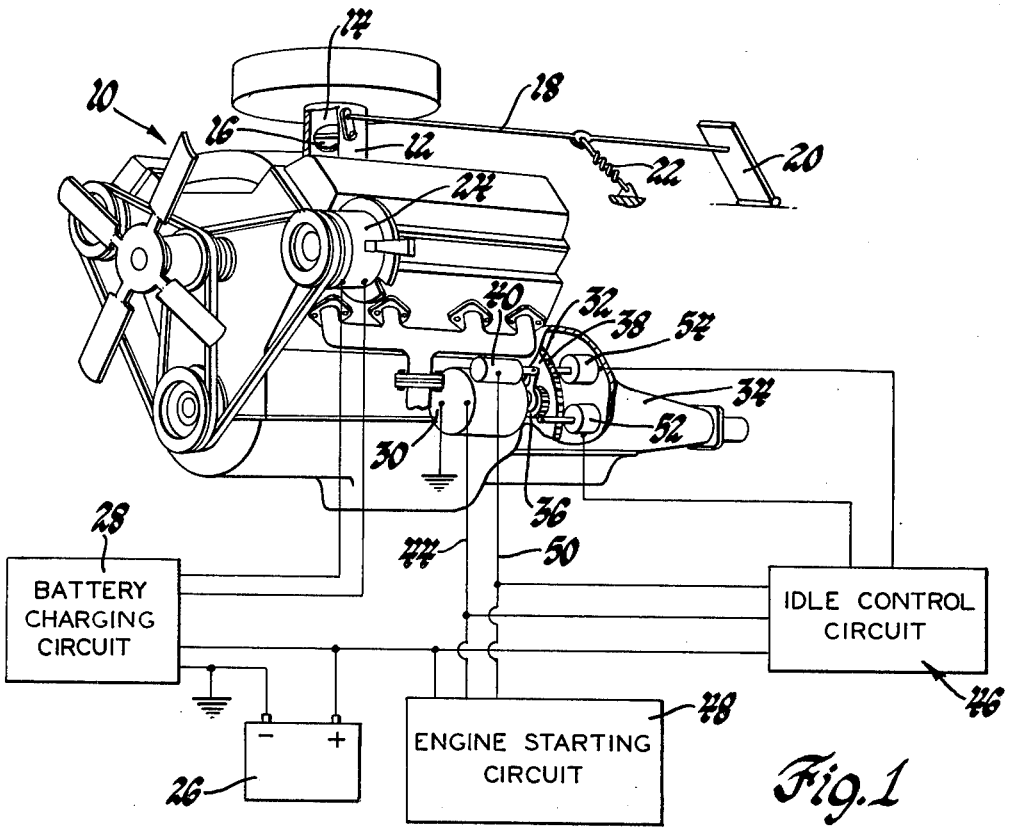

This invention relates to apparatus for effecting the idle of an internal combustion engine by an electric motor.

Ordinarily an internal combustion engine used in motor vehicles is controlled by the throttle valve in a carburetor which supplies a rich air fuel mixture to feed the engine during idle periods. Therefore, during the idle periods, fuel is consumed inefficiently while the engine is not being used to drive the vehicle.

It is therefore an object of this invention to maintain rotation of an internal combustion engine during idle periods without supplying fuel to the engine.

The invention is carried out by providing an internal combustion engine controlled by a throttle which can be closed to prevent fuel flow to the engine by providing a circuit to energize and engage the electric starter motor of the engine to continuously rotate the engine during idle periods.

Figure 2:
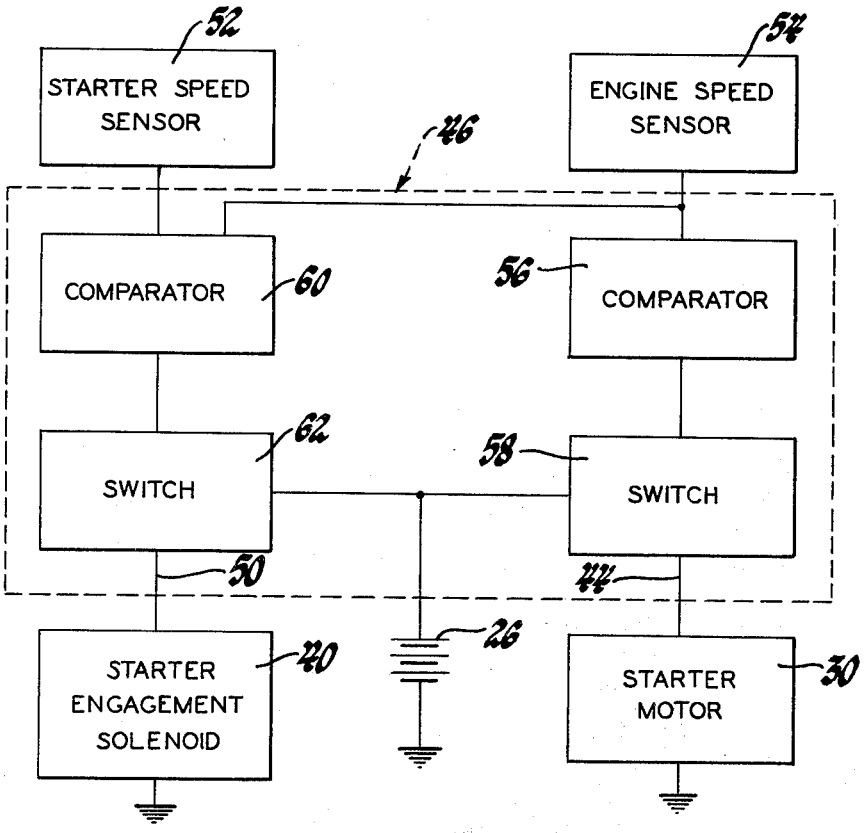

The above and other advantages will be made more apparent from the following specification taken in conjunction with the accompanying drawings wherein like reference numerals refer to like parts and wherein:

FIG. 1 is a perspective view of an engine combined with a block circuit diagram for controlling the idle condition of the engine according to the invention, and FIG. 2 is a block circuit diagram of the idle control circuit of FIG. 1.

Referring to FIG. 1, an automotive internal combustion engine 10 is provided with a carburetor 12 having an air passage 14, a throttle valve 16 in the air passage and a throttle control linkage 18 connected to the vehicle accelerator pedal 20. Spring 22 biases the throttle linkage to the throttle closed position. The carburetor 12 is not shown in detail but is the same as a conventional carburetor with the two following modifications: the throttle valve is arranged to close completely to prevent air flow through the carburetor when the accelerator pedal 20 is released, and there is no idle jet to supply fuel below the throttle valve 16. Thus when the throttle valve 16 is closed, no fuel is supplied to the engine. If desired, an auxiliary air inlet to the intake manifold may be opened during engine idling to break the partial vacuum formed by the engine rotation with the throttle 16 closed.

The engine is equipped with a generator 24 which charges a heavy duty battery 26 through a battery charging circuit 28, and an electrical starting motor 30 for cranking the engine through a flywheel 32 mounted on a transmission 34. The starter motor 30 has a drive pinion 36 which releasably engages a gear 38 on the periphery of the flywheel 32. The starter motor differs from conventional starter motors in that it is greater in power and its engagement with the flywheel 38 is controlled by a solenoid 40. The starter motor has terminals connected to ground and to line 44. The motor is rotated when line 44 is energized from the battery 26 through an idle control circuit 46 or an engine starting circuit 48. The latter circuits also control the energizing of the solenoid 40 through line 50.

A starter speed sensor 52 comprises a magnetic pickup in proximity with the teeth of the pinion 36 to provide an electrical signal proportional to the starter rotation speed. A similar pickup comprising an engine speed sensor 54 is mounted adjacent the flywheel gear 38 to sense engine speed rotation and to provide an output signal proportional thereto.

The idle control circuit 46 is shown in FIG. 2. The engine speed sensor 54 has its output connected to a comparator 56 which compares the engine speed with a preset value to determine when the engine is at idle speed. When the idle speed is sensed, the comparator 56 closes a switch 58 which connects the battery 26 to the starter motor 30 via line 44 to energize the starter motor.

The starter speed sensor 52 has its output connected to a comparator 60 which compares the starter speed with the engine speed and when those two values reach a given relationship determining gear synchronism, the comparator 60 closes a switch 62 which connects the battery 26 to the starter engagement solenoid 40 through the line 50 thereby causing engagement of the pinion 36 with the flywheel gear 38 when they are at synchronous speed.

In operation, the engine 10 is started by actuation of the engine starting circuit 48 which is like that used with conventional starter motors except that it separately energizes the starter engagement solenoid 40 simultaneously with energizing the starter motor 30. Thus the engine is cranked and started when the accelerator pedal is depressed to admit air and fuel to the engine; therefater the engine is operated normally by controlling the accelerator pedal. When, however, the accelerator pedal is released, the throttle valve closes to prevent the flow of an air fuel mixture from the carburetor to the engine. Thus during coast-down of the vehicle, no fuel is consumed and the engine is driven by the vehicle wheels through the transmission 34. When a very low vehicle speed is reached and the engine speed drops to a predetermined idel speed, the idle control circuit 46 energizes the starter motor 30 to spin up the pinion 36 to a speed synchronous with the flywheel gear speed to allow smooth gear meshing. Then the solenoid 40 is energized and the engine is rotated by the starter motor for the engine idling period. Thereafter opening of the throttle valve admits air and fuel to the engine for conventional engine operation, and the idle control circuit 46 deenergizes the starter motor when the engine speed increases above idle speed.

It will thus be seen that operation according to this invention conserves fuel by stopping the fuel flow not only during idling but also during coast-down when the throttle valve is closed. The battery, of course, must be recharged but this will occur during more efficient engine operating conditions when a normal or lean fuel mixture is used. In addition, when the vehicle is parked, the battery may be recharged from a public utility electrical source which is generally more efficient and less expensive to use than an automotive generator.

The embodiments of the invention in which an exclusive property or privilege is claimed are defined as follows:

1. In a motor vehicle propelled by an internal combustion engine a carburetor controlled by a throttle value means for supplying fuel and air to the engine, the throttle valve means being biased to a fully closed position and effective when closed to prevent air flow and fuel flow through the carburetor, a battery energized starter motor manually enabled for engagement through a starter gear and an engine drive gear to crank the engine during engine starting, means responsive to engine speed to detect an engine idle speed and to energize the starter motor during engine idle, means for sensing starter motor speed and comparing that speed with engine speed to determine gear synchronism of the engine drive gear and the starter gear, and means effective when gear synchronism is attained for engaging the starter gear with the engine drive gear whereby the engine is continuously rotated by the starter motor when the throttle valve means is fully closed.

* * * * *